US011412859B1

(12) United States Patent
Barroso

(10) Patent No.: US 11,412,859 B1
(45) Date of Patent: Aug. 16, 2022

(54) FOOTREST

(71) Applicant: Josefa Barroso, Hialeah Gardens, FL (US)

(72) Inventor: Josefa Barroso, Hialeah Gardens, FL (US)

( * ) Notice: Subject to any disclaimer, the term of this patent is extended or adjusted under 35 U.S.C. 154(b) by 0 days.

(21) Appl. No.: 17/225,502

(22) Filed: Apr. 8, 2021

(51) Int. Cl.
*A47C 16/02* (2006.01)
*A45D 29/22* (2006.01)
*A61G 13/12* (2006.01)

(52) U.S. Cl.
CPC ..... *A47C 16/025* (2013.01); *A45D 29/22* (2013.01); *A61G 13/125* (2013.01)

(58) Field of Classification Search
CPC ..... A47C 16/02; A47C 20/021; A47C 21/024; A43B 7/26
USPC ..... 297/423.41, 423.45
See application file for complete search history.

(56) References Cited

U.S. PATENT DOCUMENTS 2,120,310 A * 6/1938 Duncan ..... A01N 1/00 5/643
3,173,729 A * 3/1965 Luke ..... A61G 13/1245 297/423.26
3,345,654 A * 10/1967 Noble ..... A61G 7/0755 5/651
5,579,545 A 12/1996 Beard
5,881,406 A * 3/1999 Cobb ..... A47C 21/024 5/503.1
6,532,969 B2 3/2003 Nuzzo
7,883,151 B2 2/2011 Behmer
8,616,652 B1 12/2013 Wells
8,911,021 B1 12/2014 Styke
10,555,613 B1 * 2/2020 Harris ..... A47C 16/025
11,247,883 B2 * 2/2022 Hill ..... B66F 3/08

FOREIGN PATENT DOCUMENTS

CN 106539626 A * 3/2017

* cited by examiner

*Primary Examiner* — Sarah B McPartlin
(74) *Attorney, Agent, or Firm* — Sanchelima & Associates, P.A.; Christian Sanchelima; Jesus Sanchelima

(57) ABSTRACT

A system for a footrest including a base assembly, a shaft assembly and a leg rest assembly is disclosed. The base assembly includes a base providing proper support on a ground surface for the footrest. The shaft assembly includes a shaft mounted to the base. The shaft being telescopic to adjust the height of the shaft to accommodate different users. The shaft assembly includes a motor and control buttons for adjusting the height of the shaft. Mounted atop of the shaft is a leg rest of the leg rest assembly. The leg rest provides support to the foot and leg of the user to allow the foot to be elevated comfortably for prolonged periods of time. Mounted to the leg rest is a removable and disposable toe separator to increase sanitation for users to avoid cross contamination between users. The toe separator being secured between the toes of the user.

14 Claims, 4 Drawing Sheets

FOOTREST

BACKGROUND OF THE INVENTION

1. Field of the Invention

The present invention relates to a footrest and, more particularly, to a footrest that helps to elevate the foot of a user in a manner that provides support and comfort to the user.

2. Description of the Related Art

Several designs for footrests have been designed in the past. None of them, however, include a footrest comprising a hemispherical base having a telescopic support shaft with control buttons, and a semi-cylindrical leg rest having a heel divot and a removable, disposable toe guard. There is often a need to visit a salon to get a pedicure or to visit a podiatrist for health concerns over the foot. In order to get the feet looked at, there is often a need to elevate the feet for prolonged periods of time, which becomes tiresome. The present invention helps to provide support and comfort to the user as a foot of the user is being serviced.

Applicant believes that a related reference corresponds to U.S. Pat. No. 8,616,652 issued to for an adjustable height foot elevating support stand which includes a footprint. Applicant believes that another related reference corresponds to U.S. Pat. No. 6,532,969 for a compact, portable self-pedicure unit for use in performing self-pedicures. None of these references, however, teach of a footrest with a base having a telescopic support shaft with control buttons and a semi-cylindrical leg rest having a heel divot and a removable, disposable toe guard.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a footrest that helps to elevate the foot of a user.

It is another object of this invention to provide a footrest that provides comfort and stability to a user that has their foot elevated for prolonged periods of time.

It is still another object of the present invention to provide a footrest that facilitates getting services completed on the foot of a user.

It is another object of the present invention to provide a footrest that improves the health of a user by reducing stress on pain at the leg or foot of the user.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
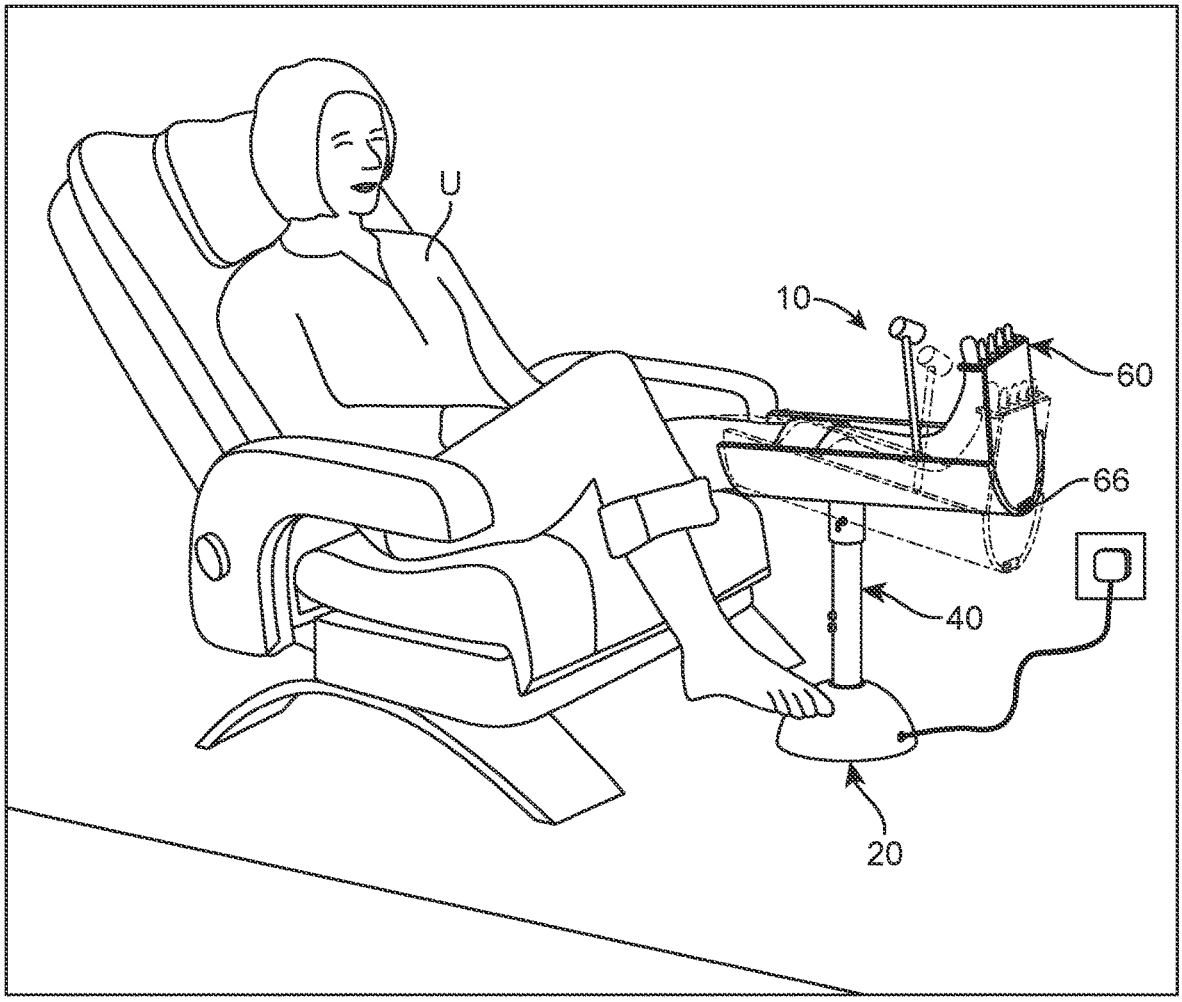
FIG. 1 represents footrest 10 in an operational setting with a user U having a foot elevated by footrest 10.

Referring now to the drawings, where the present invention is generally referred to with numeral 10, it can be observed that it, a footrest 10, basically includes a base assembly 20, a shaft assembly 40 and a leg rest assembly 60.

There is often a need to have a foot F of a user U elevated for prolonged periods of time such as when at the podiatrist or getting a pedicure. This is often tiresome. The present invention provides comfort and stability to user U as user U has foot F elevated. The present invention further helps to improve the health of user U.

Figure 2:
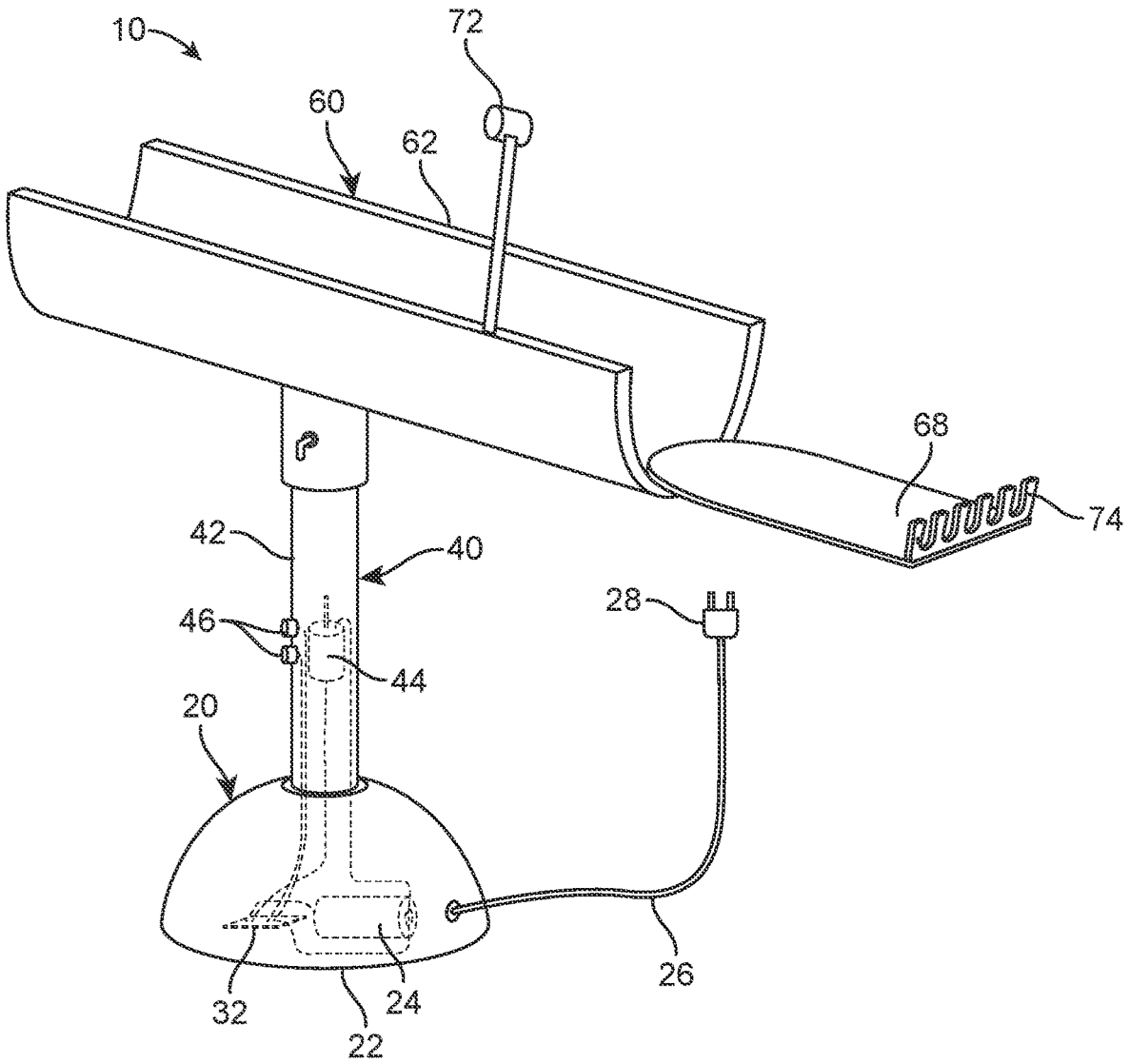
FIG. 2 shows an isometric view of footrest 10 with shaft 42 and sole cover 68 lowered.
Figure 3:
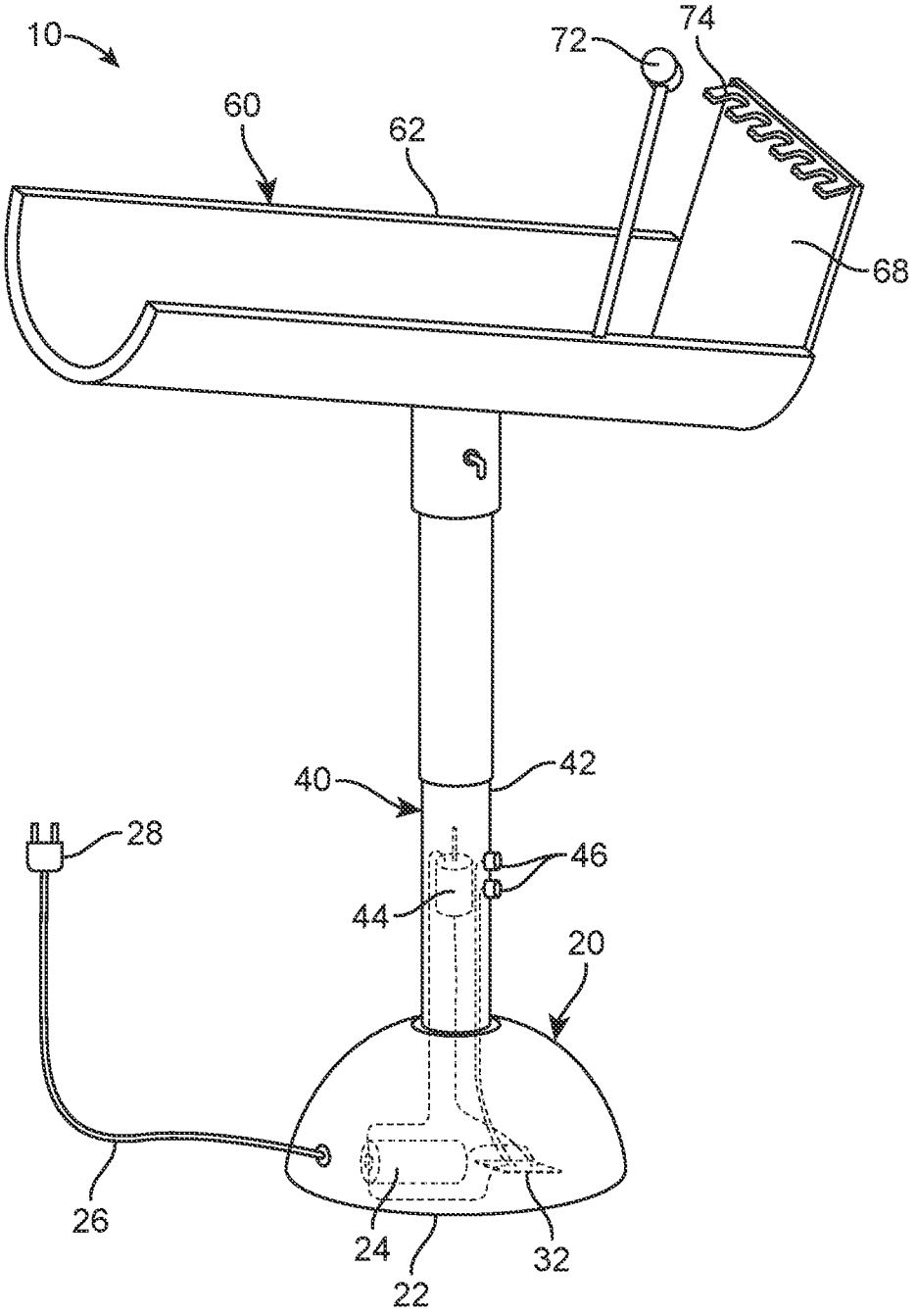
FIG. 3 illustrates an isometric view of footrest 10 with shaft 42 and sole cover 68 raised.
Figure 4:
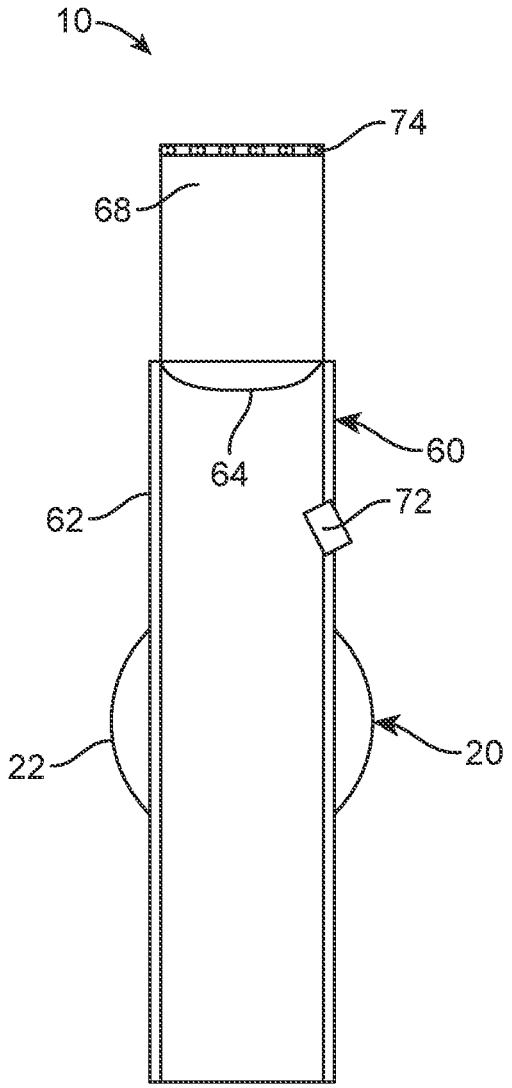
FIG. 4 is a representation of a top view of footrest 10.

It can be best seen in FIGS. 2 and 3, that base assembly 20 includes a base 22. Base 22 may provide stability to allow footrest 10 to remain upright when placed on a flat surface. It may be suitable for base 22 to be made of metal, plastic, aluminum, rubber, or other suitable materials. In one embodiment, base 22 may have a hemispherical shape to be a hemispherical base. However, it should be understood that other shapes may be suitable for base 22. In one embodiment, it may be suitable for base 22 to be tapered. Housed within base 22 may be a battery 24. Preferably, battery 24 may be rechargeable. In an embodiment, battery 24 may be removable. Battery 24 may be used to power shaft assembly 40. Further, it may be possible to power footrest 10 with a power cord 26 and a power plug 28. Power cord 26 may be mounted at a predetermined location on base 22 on one end. At a distal end of power cord 26 may be power plug 28. Power plug 28 may be connected to a power source to run energy through power cord 26 to the present invention. Additionally, it may be suitable to use power cord 26 and power plug 28 to recharge battery 24. Base assembly 20 may further include a microcontroller 32 within base 22. Microcontroller 32 may be powered by battery 24 or power cord 26. It may be suitable for microcontroller 32 to be connected to battery 24 with electrical wires.

Mounted atop of base assembly 20 may be shaft assembly 40, as best seen in FIGS. 2 and 3. Shaft assembly 40 may include a shaft 42 that is mounted onto base 22. Shaft 42 may be perpendicularly mounted onto base 22. Shaft 22 may preferably be telescopic to be adjustable in height. Shaft 42 may have an expanded and collapsed configuration. Shaft 42 may also be referred to as a telescopic support shaft. Shaft 42 may have a cylindrical shape. However, it is to be understood that it may be suitable for shaft 42 of a different shape. Shaft assembly 40 may importantly include a motor 44 within shaft 42. Motor 44 may help to raise and lower shaft 42. Motor 44 helps shaft 42 to achieve the expanded and the collapsed configuration. It should be understood that shaft 42 may be connected to battery 24 and microcontroller 32. Battery 24 or power cord 26 may provide power to motor 44 to allow motor 44 to operate. Microcontroller 32 may help motor 44 to determine whether to raise or lower shaft 42. Shaft assembly 40 may additionally include control buttons 46. Control buttons 46 may be adjacent to each other. Preferably, control buttons 46 may be mounted to an exterior shaft 42. In one embodiment, control buttons 46 may extend outwardly and away from shaft 42. One of control buttons 46 may actuate motor 44 to raise shaft 42. Another of control buttons 46 may actuate motor 44 to lower shaft 42. Control buttons 46 may be connected to microcontroller 32 in order to communicate with motor 44 to adjust the height of shaft 42. Upon microcontroller 32 receiving a signal from control buttons 46 the height of shaft 42 is adjusted with motor 44.

It can be best seen in FIGS. 2 and 3, that mounted atop of shaft assembly 40 may be leg rest assembly 60. Leg rest assembly 60 may provide support for the leg and foot F of user U, as best seen in FIG. 1. Leg rest assembly 60 includes leg rest 62. Leg rest 62 may be mounted onto shaft 42. It may be suitable for an adjusting knob 63 be secured to shaft 42. Adjusting knob 63 may help to adjust the incline of leg rest 62 for comfort to user U. Adjusting knob 63 may be entirely below leg rest 62. Leg rest 62 may be angled at various predetermined angles. Adjusting knob 63 may extend outwardly and away from shaft 42. Adjusting knob 63 may include a grasping member to facilitate adjusting the angle of leg rest 62. Adjusting knob 63 may be L shaped, in one embodiment. Leg rest 62 may be perpendicularly mounted onto shaft 42, in one embodiment. It may be suitable for base 22 and leg rest 62 to be parallel to each other. Leg rest 62 may be slightly curved, in one embodiment, to cooperate with the lower body of user U. In the preferred embodiment, leg rest 62 may be substantially semi-cylindrical in shape and elongated. However, it is to be understand that leg rest 62 may have other shapes in alternate embodiments. User U may use leg rest 62 for support of a leg and foot F. Leg rest 62 may further elevate foot F of user U. Leg rest 62 may preferably be comfortable for user U. Leg rest 62 may be made of materials such as plastic, wood, aluminum, metal, stainless steel, polyurethane, cotton, canvas, comfort gel, memory foam, wool, polyester or combinations thereof. It is to be understood that preferably, leg rest 62 may have a length greater than a height. Mounted on leg rest 62 at a predetermined location may be a heel divot 64. Heel divot 64 may indicate where user U is to rest their heel on leg rest 62, With a heel properly in place on heel divot 64, foot F of user may be vertical with the toes being up in the air. Heel divot 64 may be slight recessed within leg rest 62. In the preferred embodiment, heel divot 64 may be shallow. It is to be understood that heel divot 64 may be semi-circular in shape, in one embodiment.

Mounted to a distal end of leg rest 62 may be a hinge 66 which attaches sole cover 68 to leg rest 62. It is to be understood that sole cover 68 may be adjacent to leg rest 62. It can be seen in FIG. 2, that sole cover 68 may have a lowered configuration. It can be seen in FIG. 3, that sole cover 68 may have a raised configuration. Sole cover 68 in the raised configuration may entirely cover the sole of user U. It is to be understood, that in one embodiment, sole cover 68 may be flat. In another embodiment, sole cover 68 may have a shape or curvature similar to leg rest 62. However, it is to be understood that in such an embodiment, the shape of sole cover 68 may cooperate with the shape of leg rest 62 to be partially received adjacently to the interior or exterior of the sidewalls of leg rest 62. Hinge 66 may extend entirely across the width of sole cover 68 in one embodiment. It may also be suitable for hinge 66 to partially extend across the width of sole cover 68 in an alternate embodiment. It may be suitable for footrest 10 to include a locking member that cooperates with sole cover 68 in order to maintain sole cover 68 in the raised configuration. The locking member may be mounted onto leg rest 62 or sole cover 68. It may be suitable for the locking member to engage leg rest 62 or sole cover 68 depending on where the locking member is mounted to. It is to be understood that in one embodiment, sole cover 68 may extend underneath of the toes of user U. It may be suitable for the distal end of sole cover 68 to be shaped like toes. In an alternate embodiment, it may be suitable for sole cover 68 to extend just below the toes of user U, leaving toes uncovered from underneath with sole cover 68.

Mounted to sole cover 68 may be a light 72. Light 72 may be at a predetermined location on leg rest 62 or sole cover 68. It may be suitable for light 72 to emit light onto sole cover 68. Light 72 may help to illuminate foot F of user U to more easily inspect or work on foot F. In one embodiment, it may be suitable for light 72 to extend outwardly and away from leg rest 62 or sole cover 68. It is to be understood that it may be suitable for the present invention to include multiple of light 72. A toe separator 74 may preferably be mounted to sole cover 68. Toe separator 74 may extend outwardly and away from sole cover 68. Toe separator 74 helps to keep the toes spread apart for the ease of viewing or examining each of the toes of user U. It is to be understood that toe separator may be removable or detachable from sole cover 68. Toe separator 74 may be disposable. Toe separator 74 may help to improve sanitation or health concerns for user U. Toe separator 74 may be replaced for each of user U to help prevent illnesses, diseases or concerns being transmitted from one person to another. Toe separator 74 may help to prevent nail fungus to be transferred from person to person, for example. Toe separator 74 may be made of materials which are disposable or recyclable such as paper, plastic, cotton or the like. Toe separator 74 may preferably extend the width of sole cover 68. Toe separator 74 may have portions to separate each toe, which are interconnected. Sole cover 68 may be parallel to leg rest 62 when sole cover 68 is in the raised configuration. It may be suitable for toe separator 74 to be perpendicular to sole cover 68 when toe separator 74 is mounted thereto.

Footrest 10 may help to provide comfort and stability to foot F of user U as foot F is elevated. It may be necessary to elevate foot F to receive medical care or a pedicure. Having foot F elevated for extended periods of time may be tiresome, which is why the present invention facilitates elevating of foot F. User U may all be of different sizes and shapes, hence, shaft 42 is made telescopic to allow accommodating users of different sizes.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a footrest, comprising:

a) a base assembly including a base;

b) a shaft assembly including a shaft, said shaft mounted atop of said base, said shaft being adjustable in height, said shaft assembly including control buttons mounted to said shaft, said control buttons selectively expanding or retracting said shaft to adjust the height of said shaft; and c) a leg assembly including a leg rest mounted atop of said shaft, said leg rest supporting the foot of a user, said leg rest including a heel divot, said heel divot to receive the heel of the user maintaining the foot upright, said leg assembly further including a toe separator configured to be positioned underneath the toes of the user, wherein said leg assembly further includes a sole cover, said sole cover being hingedly mounted to a distal end of said leg rest, said sole cover having a lowered configuration and a raised configuration., said sole cover being perpendicular to said leg rest in the raised configuration, said sole cover adapted to cover the sole of the foot of the user.

2. The system of claim 1, wherein said base is hemispherical in shape.

3. The system of claim 1, wherein said shaft is telescopic to adjust the height of said shaft.

4. The system of claim 1, wherein said leg rest is semi-cylindrical in shape.

5. The system of claim 1, wherein said toe separator is disposable and recyclable.

6. The system of claim 1, wherein said shaft is perpendicular to said base.

7. The system of claim 1, wherein said base and said leg rest are parallel to each other.

8. The system of claim 1, wherein said heel divot is recessed within said leg rest.

9. The system of claim 1, wherein said base assembly includes a microcontroller and said shaft assembly includes a motor, said microcontroller, said motor and said control buttons being interconnected, said control buttons actuating said motor to lower or raise the height of said shaft upon receiving of a signal from said microcontroller.

10. The system of claim 9, wherein said base assembly includes a rechargeable battery within said base to provide power to said microcontroller, said motor and said control buttons.

11. The system of claim 9, wherein said base assembly further includes a power cord mounted to said base, said power cord having a power plug connected thereto, said power cord and said power plug connecting to a power source to provide power to said microcontroller, said motor and said control buttons.

12. The system of claim 1, wherein said toe separator is mounted perpendicularly to said sole cover.

13. The system of claim 12, wherein said toe separator extends an entire width of said sole cover, said toe separator extends outwardly and away from said sole cover.

14. The system of claim 1, wherein said leg rest assembly further includes a light, said light mounted to said leg rest, said light configured to illuminate said sole cover and said foot of the user.

* * * * *